US011510472B2

(12) United States Patent
Julemont

(10) Patent No.: US 11,510,472 B2
(45) Date of Patent: Nov. 29, 2022

(54) ROTARY BLOWER BRUSH WITH IMPROVED ERGONOMICS

(71) Applicant: BaByliss Faco sprl, Wandre (BE)

(72) Inventor: Pierre Julemont, Soumagne (BE)

(73) Assignee: BaByliss Faco sprl, Wandre (BE)

( * ) Notice: Subject to any disclaimer, the term of this patent is extended or adjusted under 35 U.S.C. 154(b) by 279 days.

(21) Appl. No.: 16/640,862

(22) PCT Filed: Aug. 14, 2018

(86) PCT No.: PCT/EP2018/072034
§ 371 (c)(1),
(2) Date: Feb. 21, 2020

(87) PCT Pub. No.: WO2019/042763
PCT Pub. Date: Mar. 7, 2019

(65) Prior Publication Data

US 2021/0037945 A1 Feb. 11, 2021

(30) Foreign Application Priority Data

Sep. 1, 2017 (EP) ..... 17189103
Sep. 22, 2017 (EP) ..... 17192660

(51) Int. Cl.
*A45D 20/50* (2006.01)
*A46B 9/02* (2006.01)
(Continued)

(52) U.S. Cl.
CPC ..... *A45D 20/50* (2013.01); *A45D 20/12* (2013.01); *A46B 9/023* (2013.01); *A46B 13/001* (2013.01);
(Continued)

(58) Field of Classification Search
CPC ..... A45D 20/50; A45D 20/12; A46B 9/023; A46B 13/001; A46B 13/005; A46B 13/0051
(Continued)

(56) References Cited

U.S. PATENT DOCUMENTS 1,485,983 A * 3/1924 Hudson ..... A45D 20/44 34/99
2,962,576 A * 11/1960 Russell ..... A45D 20/12 392/379
(Continued)

FOREIGN PATENT DOCUMENTS

CN 202890943 U 4/2013
DE 3319402 A1 5/1984
(Continued)

OTHER PUBLICATIONS

European Patent Office, International Search Report and Written Opinion of the International Search Authority of the International Searching Authority, dated Oct. 17, 2018, in PCT/EP2018/072034, which is the international application to this U.S. application.

*Primary Examiner* — Stephen M Gravini
(74) *Attorney, Agent, or Firm* — Kolitch Romano Dascenzo Gates LLC

(57) ABSTRACT

A hairstyling device of the rotary blower brush type may include a handle having two zones of different diameters D1 and D2. The first diameter is greater than the second (i.e., D1>D2), such that the greater diameter can accommodate a compressor. The compressor facilitates a substantially constant air flow. The smaller diameter zone corresponds to a gripping zone that facilitates more ergonomic handling compared to known devices.

37 Claims, 10 Drawing Sheets

(51) Int. Cl.
*A46B 13/00* (2006.01)
*A46B 15/00* (2006.01)
*A45D 20/12* (2006.01)

(52) U.S. Cl.
CPC ..... *A46B 13/005* (2013.01); *A46B 15/0051* (2013.01)

(58) Field of Classification Search
USPC ..... 34/95–100
See application file for complete search history.

(56) References Cited

U.S. PATENT DOCUMENTS

| | | | | | |
|---|---|---|---|---|---|
| 3,006,079 | A * | 10/1961 | Jepson | A45D 20/18 | 34/99 |
| 3,890,984 | A * | 6/1975 | Lesetar | A45D 20/50 | 132/271 |
| 4,469,934 | A * | 9/1984 | Isshiki | A45D 1/04 | 132/118 |
| 6,067,724 | A * | 5/2000 | Depoyian | A45D 20/12 | 34/97 |
| 6,098,635 | A * | 8/2000 | Marino | A46B 17/06 | 132/238 |
| 7,047,660 | B2 * | 5/2006 | Leventhal | A45D 20/122 | 34/97 |
| 7,082,949 | B2 * | 8/2006 | Julemont | A45D 1/12 | 132/266 |
| 9,289,054 | B2 * | 3/2016 | Ragosta | A45D 7/02 | |
| 9,521,891 | B2 * | 12/2016 | Ragosta | A45D 7/02 | |
| 10,143,284 | B2 * | 12/2018 | Depoyian | A45D 1/04 | |
| 11,224,274 | B2 * | 1/2022 | Kim | A45D 1/20 | |
| 2008/0223387 | A1 * | 9/2008 | Julemont | A45D 2/002 | 132/118 |
| 2014/0083446 | A1 * | 3/2014 | Julemont | A45D 7/02 | 132/211 |
| 2021/0037945 | A1 * | 2/2021 | Julemont | A46B 15/0051 | |
| 2022/0007809 | A1 * | 1/2022 | Wang | A45D 20/12 | |

FOREIGN PATENT DOCUMENTS

| | | | | |
|---|---|---|---|---|
| EP | 1491109 | A1 * | 12/2004 | A45D 1/12 |
| EP | 1576900 | B1 | 7/2009 | |
| EP | 2335515 | A1 | 6/2011 | |
| EP | 2823726 | B1 | 8/2016 | |
| JP | 2004-254897 | A | 9/2004 | |
| WO | 2005/018372 | A1 | 3/2005 | |
| WO | 2012/156208 | A1 | 11/2012 | |
| WO | 2013/014093 | A1 | 1/2013 | |
| WO | 2013/041805 | A1 | 3/2013 | |
| WO | WO-2019042763 | A1 * | 3/2019 | A46B 15/0051 |

* cited by examiner

ROTARY BLOWER BRUSH WITH IMPROVED ERGONOMICS

INTRODUCTION

Rotary blower brushes are well known by those skilled in the art. They work as a hairdryer, the handle of which is coaxial with the hairstyling accessory. This type of device typically comprises a heater and two motors, one of the two motors making it possible to actuate a fan located in the handle and the second motor allowing the hairstyling accessory, which is generally removable, to rotate. This second motor may be located in the handle or outside the handle.

Documents EP3169182; WO2013041805; EP2823726; EP1576900; DE3319402; WO2005/018372 and U.S. Pat. No. 3,890,984 describe typical rotary blower brushes.

Document JP2004-254897 discloses a rotary blower brush having a first motor arranged in the handle used to produce a flow of air and a second motor arranged in the brush allowing the brush to rotate.

Document EP2335515 B1 discloses an electric hairbrush comprising a handle, a heating element, a first motor driving a fan and a second motor driving a hairstyling accessory in rotation, where the fan and the first motor are comprised inside the handle and the second motor outside the handle.

The rotary blower brushes of the state of the art nevertheless all share a very bulky handle that is not very ergonomic, even when the motor driving the accessory is located outside the handle. By moving the second motor outside the handle, it is possible to free up a little space for letting the flow of air pass, but even in this configuration, the handle still remains very bulky. This is primarily due to the difficulty of circulating air through the handle with all the elements necessary for operating the device, and in particular due to the often substantial diameter of the fan, which must be located in the handle and which suctions the air at one end of the handle to discharge it from the other.

SUMMARY

The present invention helps to significantly improve the circulation of the air flow and the ease of operation of the device.

The present invention relates to a hairstyling device of the rotary blower brush type comprising a handle having two zones of different diameters D1 and D2, the first diameter being substantially greater than the second (D1>D2), the zone of greater diameter D1 accommodating a compressor allowing the obtention of a substantially constant air flow and a gripping zone having a diameter D2 allowing more ergonomic holding compared to known devices.

The aim of the present invention is to overcome the drawbacks of the state of the art by proposing a rotary electric blower brush comprising a handle having two substantially different diameters making it possible on the one hand to accommodate a high-performing compressor in the wider part and on the other hand to make the gripping part of the device as thin as possible so as to improve its ergonomics without sacrificing the functions of the device.

The present invention discloses a rotary blower brush of length L comprising a handle, a heater, a first motor for driving a compressor and a second motor for driving a brush in rotation, the first motor, the heater and the compressor being positioned in the handle and the second motor for driving the rotary brush being located outside the handle in a support rod, characterized in that the handle comprises two separate zones of substantially different diameters D1 and D2, the first diameter D1 being substantially greater than the second diameter D2, the zone of diameter D1 accommodating the compressor and the zone of diameter D2 corresponding to the gripping zone of the rotary blower brush.

The preferred embodiments of the invention are covered in the secondary claims and in the figures and comprise one or several of the following features:

- the diameter D2 is 10% smaller than the diameter D1, preferably 15% smaller than the diameter D1 and particularly preferably 20% smaller than the diameter D1;
- the diameter D2 of the gripping zone 7 represents less than 15% of the total length L, preferably less than 12% and particularly preferably less than 9%;
- the compressor 5 maintains a substantially constant flow rate between 300 and 1000 l/min, preferably between 350 and 850 l/min and particularly preferably between 400 and 600 l/min;
- the ratio between the power of the heater in watts and the air flow rate in l/min is between 1 and 2.5, preferably between 1.5 and 2.5, and particularly preferably between 1.5 and 2;
- the transition zone between the diameter D1 and the diameter D2 on the handle 2 comprises straightening fins 16 for the air flow coming from the compressor 5;
- the two motors (4, 6) are brushless motors;
- D1 is between 45 and 60 mm, preferably between 48 and 55 mm and particularly preferably between 50 and 54 mm;
- the diameter D2 is between 35 and 45 mm, preferably between 37 and 43 mm and particularly preferably between 39 and 41 mm;
- L is between 300 and 400 mm, preferably between 320 and 380 mm and particularly preferably between 330 and 360 mm;
- the handle comprises at its outlet a temperature sensor controlled by the heating power so as to avoid overheating of the device;
- the cylindrical brush comprises air outlet openings arranged at least partially in concentric rings 9, the diameter of these rings decreasing toward the end when one moves away from the handle 2;
- the handle 2 comprises an ion generator 14 located in the extension of the motor 4 of the compressor 5;
- the support rod 8 of the motor 6 comprises a polygonal coupling element 10 cooperating with the cylindrical brush 17;
- the cylindrical brush 17 is made up of a metal covered with a ceramic layer;
- a temperature sensor is placed on the support rod so as to allow the air flow and the heating power of the device to be adjusted;
- the brush comprises a system for detecting the type of the cylindrical brush, allowing the air flow, the heating power of the device and the rotation speed of the motor to be adjusted.

NUMERICAL REFERENCES OF THE FIGURES

Figure 1:
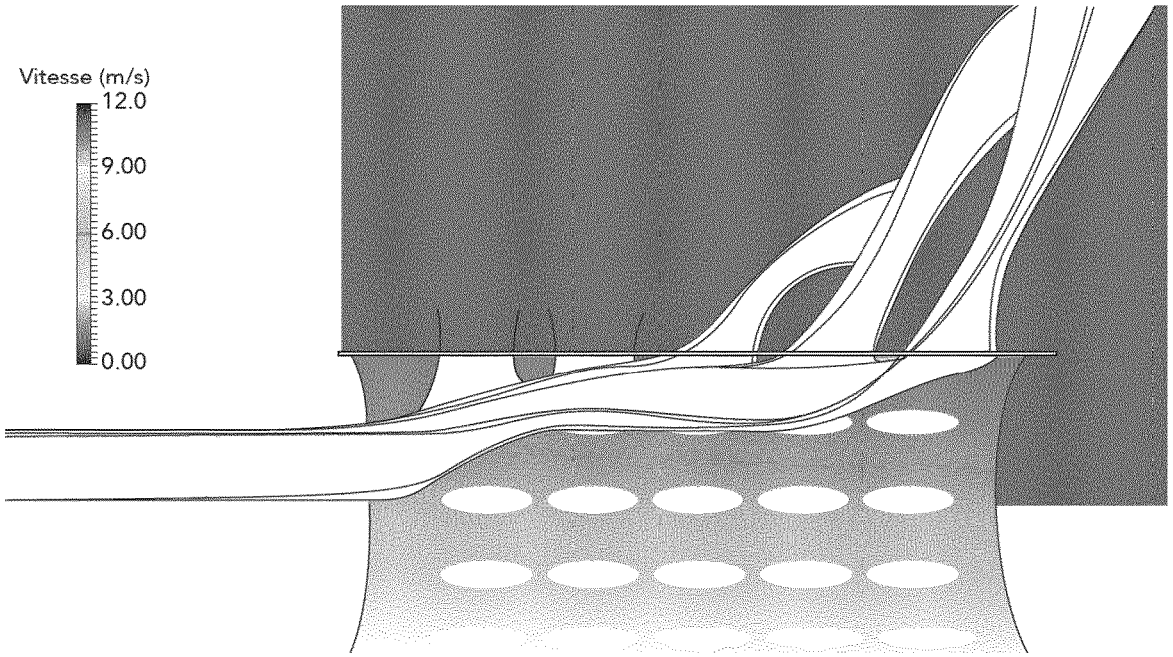
FIG. 1 shows the stream of the air flow around a typical rotary brush of the state of the art. The outgoing air flow is poorly distributed around the brush and chooses the exit path of least resistance.

1: Rotary blower brush
2: Handle having two different diameters
3: Heater
4: First motor located in the handle
5: Compressor allowing a substantially constant air flow
6: Second motor located outside the handle in the recess of the support rod
7: Ergonomic gripping zone of the handle
8: Fixed (non-removable) support rod of the motor
9: Air discharge openings arranged in concentric rings
10: Male polygonal coupling cooperating with a female element on the cylindrical brush
11: Slightly protruding mechanism for locking the cylindrical brush
12: Heating element
13: Switch allowing rotation in the clockwise and counterclockwise directions
14: Ionizer
15: Outer protective grid
16: Straightening fins
17: Cylindrical brush with bristle tufts and openings positioned in rings
18: Support for foam filter
19: Hinge allowing the protective grid to be opened and maintained
20: Off-centered power supply
21: Notch on the protective grid for the passage of the power supply
22: Fins for attaching the motor support rod to the handle
23: Aerodynamic tip associated with the attaching fins
24: Inner protective grid
25: Lever system for the clockwise and counterclockwise rotation switch
26: Rotary electrical contact
27: Axis of the second motor
28: Outer assembly ring of the two shells
29: Half-shells of the handle
30: Filter
31: Gearbox
32: Closing cover of the support rod

DETAILED DESCRIPTION

Figure 3:
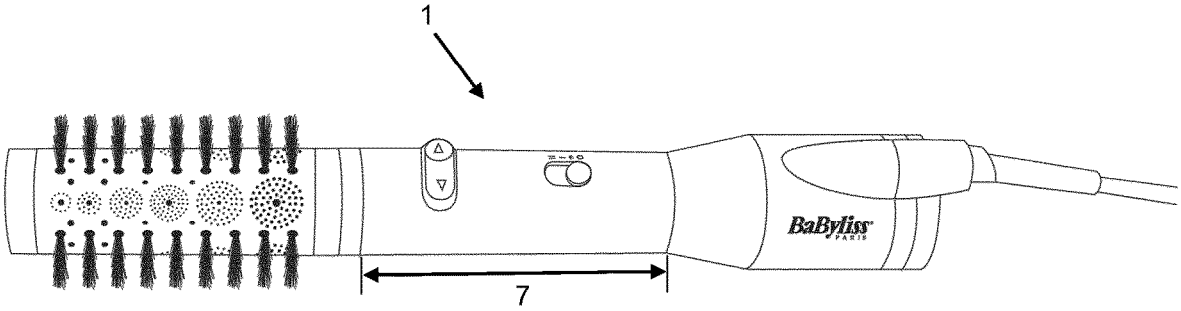
FIG. 3 shows a 3D figure of the rotary blower brush according to the invention with its two different handle diameters.
Figure 4:
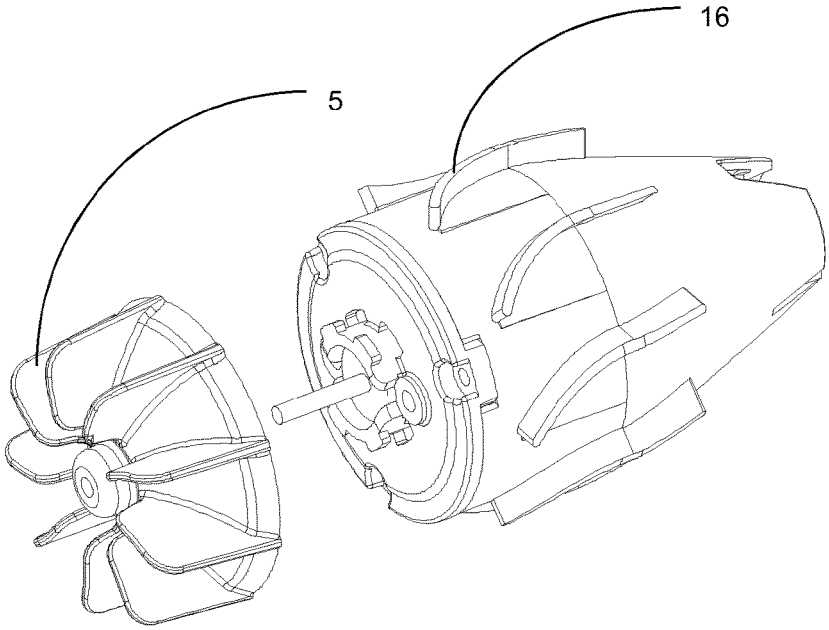
FIG. 4 shows the arrangement of the compressor in the widest part of the handle having a diameter D1 and the air flow straightening fins in the transition zone between diameters D1 and D2 of the handle.
Figure 5:
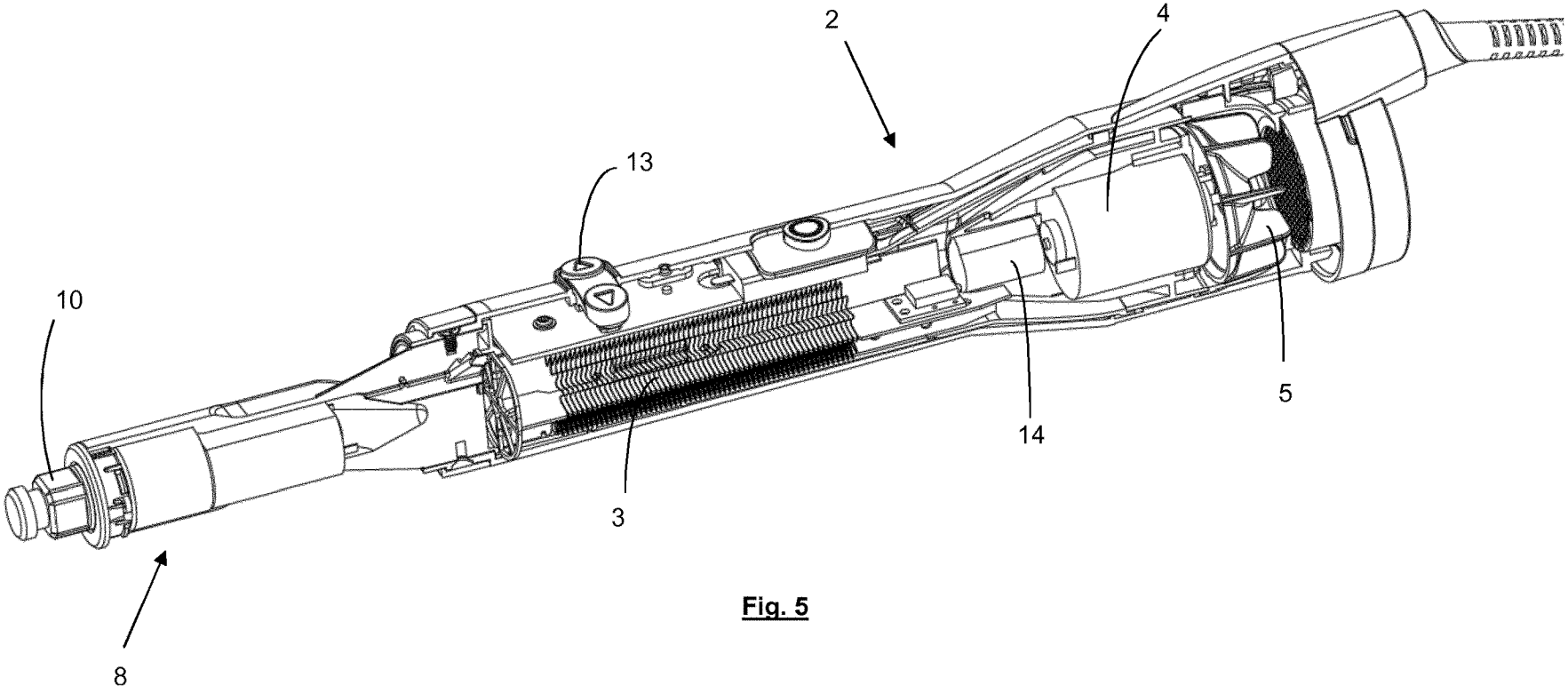
FIG. 5 shows the skeleton of the device according to the invention with the inner elements but without the cylindrical brush. This illustration makes it possible to show the support rod which comes out of the handle while supporting the second motor and which makes it possible, via a polygonal coupling element, to drive the cylindrical brush in rotation.
Figure 6:
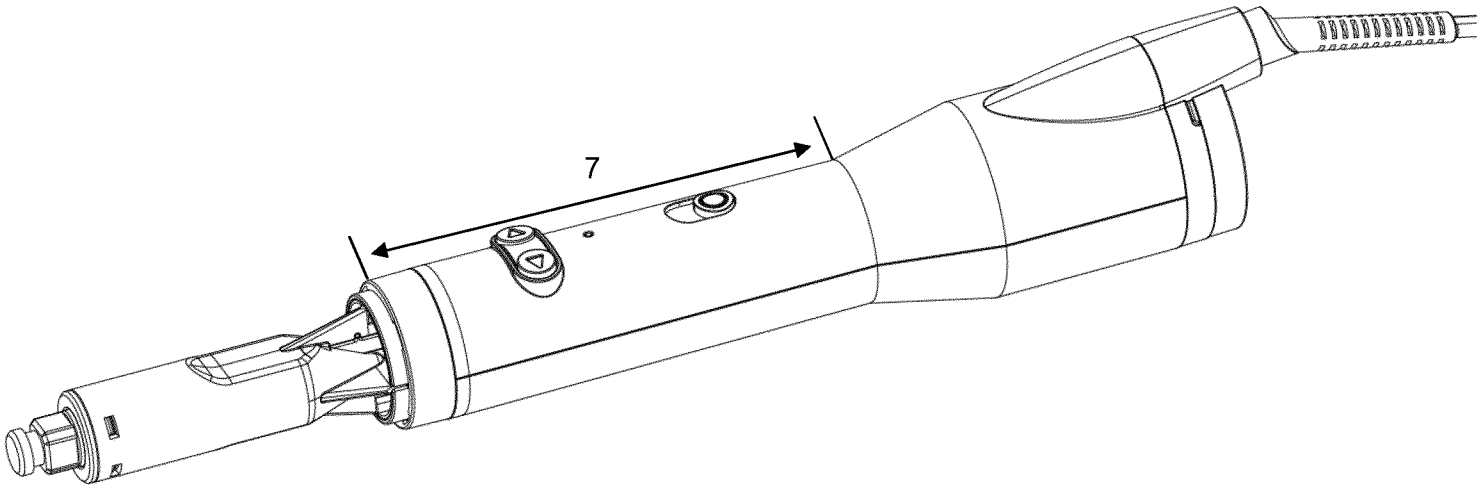
FIG. 6 is another illustration of the device according to the invention seen from the outside.
Figure 7:
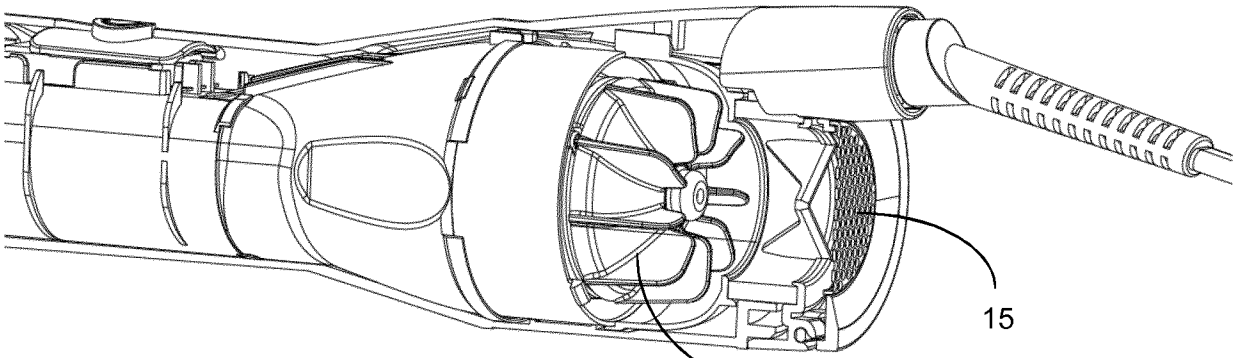
FIG. 7 shows a detailed view of the arrangement of the compressor in the wide part D1 of the handle.

The present invention discloses an electric rotary blower brush comprising an elongated handle that is particularly ergonomic and in which are arranged a heater and a compressor driven by a first motor allowing the air to be suctioned at one end of the device and to blow it through heating elements, toward a rotary accessory. The rotary accessory is preferably a removable cylindrical brush with bristle tufts which is arranged on a support rod at the opposite end of the handle and driven by a second motor arranged outside the handle on a support rod located in the longitudinal axis of the handle. This configuration allows faster and more homogeneous styling of the hair than other known devices (FIG. 3).

Figure 12:
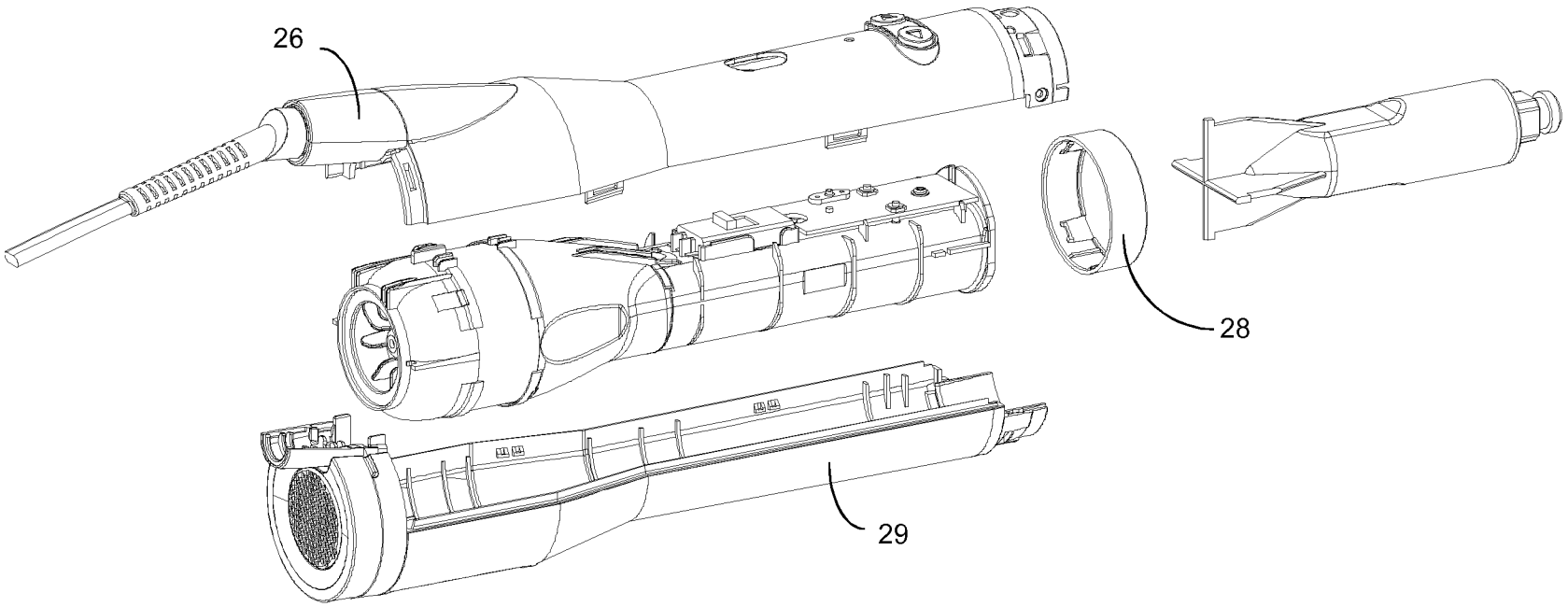
FIG. 12 shows an exploded view of the device according to the invention.

The location where the air passes between the handle and the support rod of the second motor was the object of an in-depth aerodynamic analysis. Relative to the configurations of the state of the art, the pointed aerodynamic shape associated with fins of the rocket tail type allows an optimized air flow through the device. It also simplifies the construction of the device with regard to the molded plastic parts and allows the support rod to be solidly and more easily attached to the handle. The handle is formed of two half-shells that are assembled and tightened around the fins for attaching the support rod of the second motor by an assembly ring. This construction makes it possible to simplify the construction of the device while ensuring that the support rod of the second motor is rigidly attached (FIG. 12).

Figure 2:
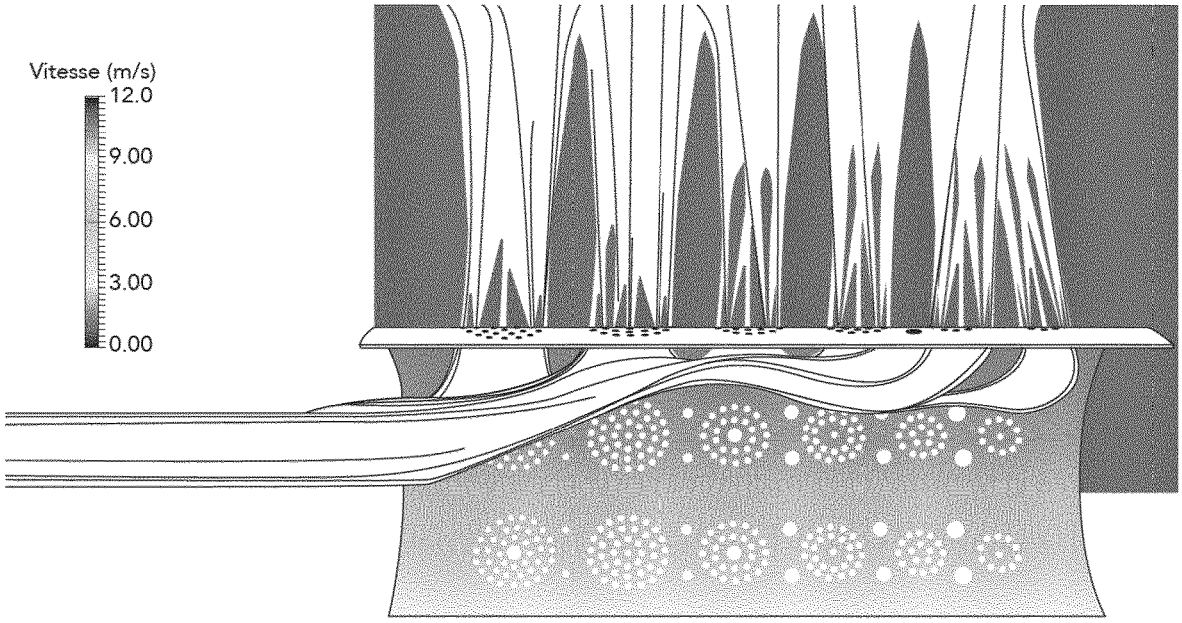
FIG. 2 shows the stream of the air flow around a rotary brush according to the invention having openings arranged in concentric rings, the diameter of which decreases when one moves away from the handle. The air flow is thus uniformly distributed around the brush.
Figure 8:
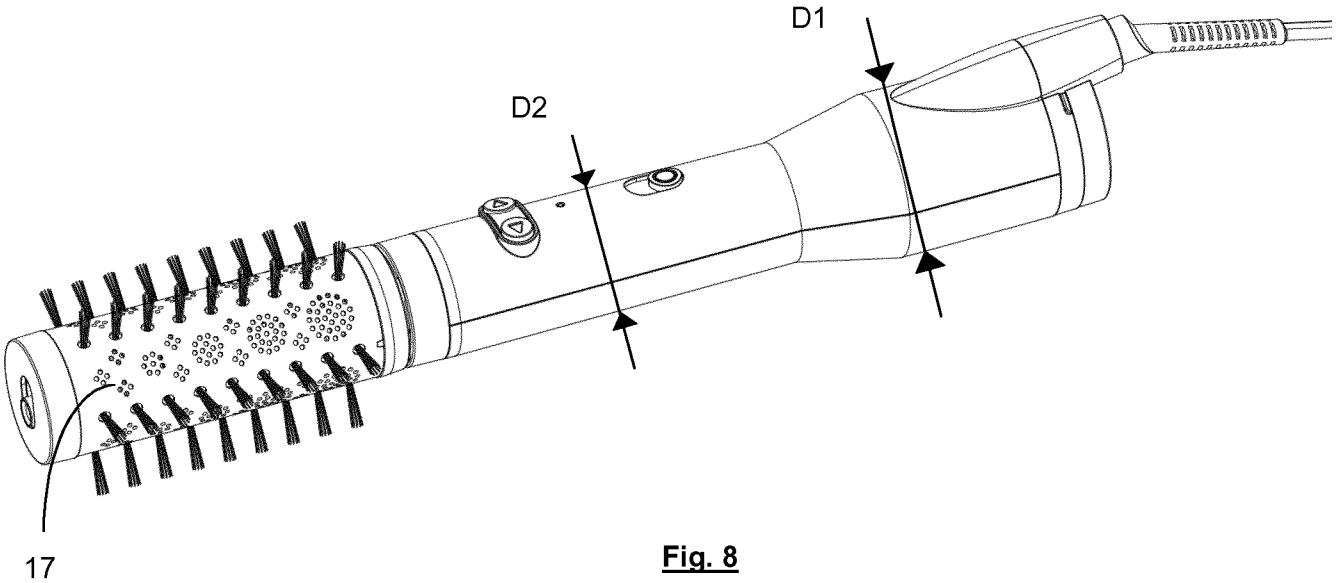
FIG. 8 shows a front view of the device according to the invention.

To improve the ergonomics of the rotary blower brush according to the present invention, this brush comprises a handle having two substantially different diameters D1 and D2. Such a blower brush, provided with a cylindrical brush having bristle tufts, and air outlets, which are not uniformly disposed on the cylindrical brush, but carefully arranged, allows the hair to be styled by winding an entire or partial lock around the brush. The removable cylindrical brush comprises bristle tufts and air outlet openings distributed by section or by decreasing number toward the end of the device over its cylindrical surface (see FIGS. 8, 10 and 11). This sectional arrangement and/or in decreasing number of air openings toward the end of the accessory, associated with an ergonomic handle comprising a compressor able to maintain a substantially constant air flow, even when the air outlet openings on the brush are partially obstructed, allows the air flow to be more homogeneously distributed around the brush (see FIGS. 1 and 2).

Figure 9:
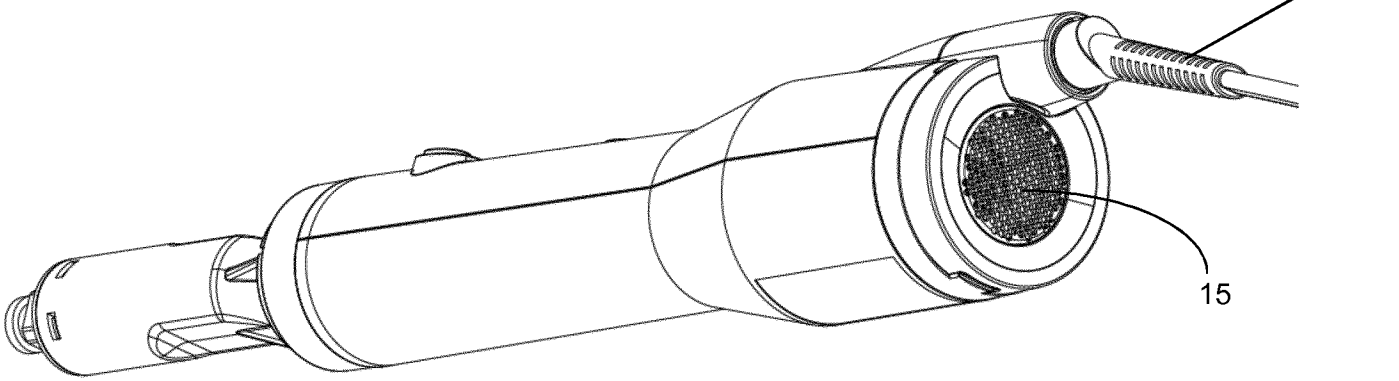
FIG. 9 shows a rear view of the device according to the invention
Figure 13:
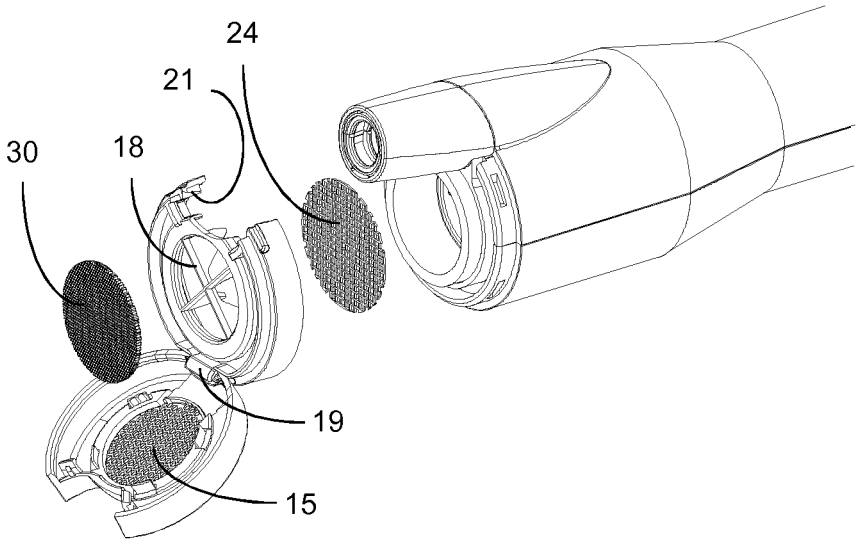
FIG. 13 shows the opening mechanism for cleaning the suction grids and the filter.

To optimize the air flow, the suction of air, through the outer protective grid, must be centered on the longitudinal axis of the device, and the power supply is thus off-centered. The off-centered positioning of the power supply implies that a rotary electrical contact is needed at the connection point with the cable to improve the ergonomics of the device during different handling occasions by the user (see FIGS. 9 and 13).

By selecting a high-performing compressor that makes it possible to maintain a substantially constant air flow, by positioning it in a part of the handle having an enlarged diameter D1, by guiding this air flow straightened by fins, to avoid turbulence, through a thinner handle having a diameter D1 and thanks to a vetted configuration of the heating resistances (see FIGS. 15 and 16), it is possible to improve the ergonomics of the gripping zone while generating an air flow that is completely uniform through openings on the cylindrical brush by decreasing the number and/or the section of the openings when one moves away from the handle. This can be done in different ways, either by making increasingly small openings along the longitudinal axis of the cylindrical brush, or by decreasing the number thereof.

The device according to the present invention also comprises a mechanism that recognizes the accessory used, for example cylindrical brushes having different diameters. This recognition mechanism allows the air flow, the heating power and the rotation speed of the rotary brush to be controlled.

Figure 10:
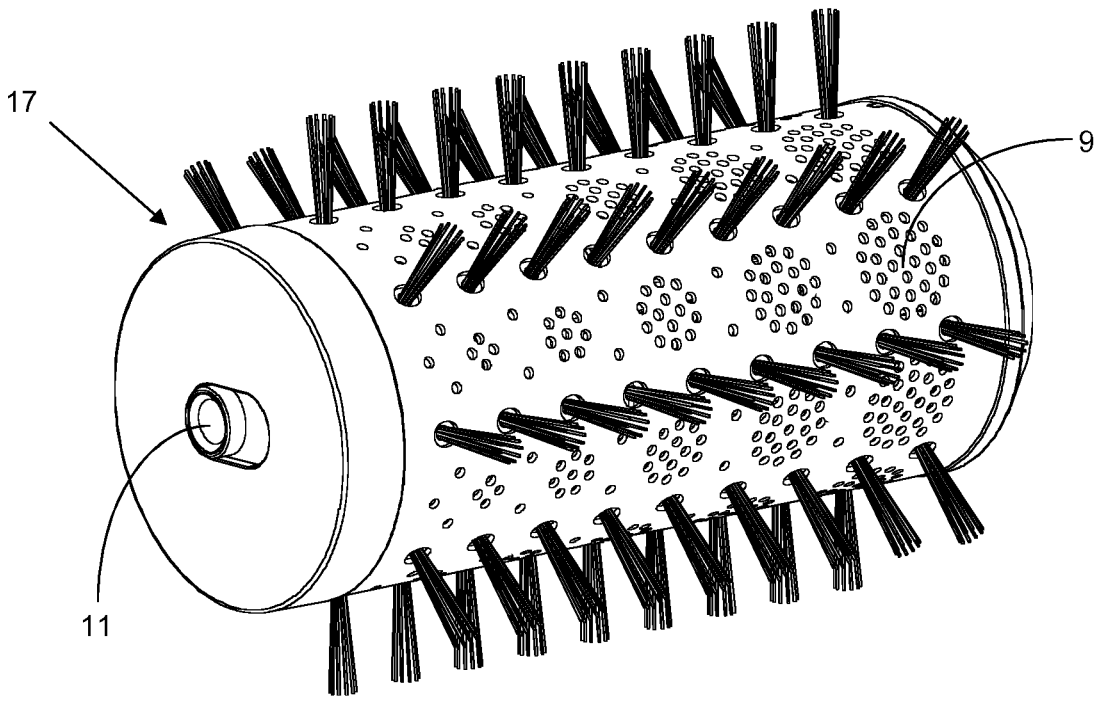
FIG. 10 shows a detailed view of a cylindrical brush having bristle tufts, that may be attached on the device according to the invention. The air outlet openings are arranged at least partially in concentric rings, the diameter of which decreases as one moves away from the handle.
Figure 11:
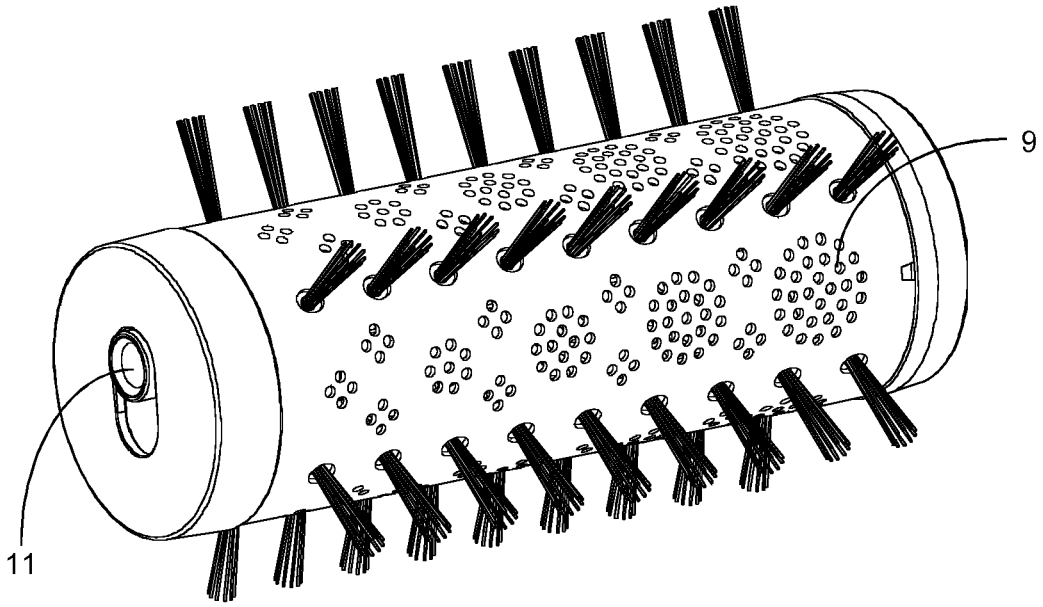
FIG. 11 shows a detailed view of another cylindrical brush having bristle tufts, that may be attached on the device according to the invention.

According to one preferred embodiment of the invention, the air outlet openings on the cylindrical brush are arranged at least partially in concentric rings, the diameter of which becomes increasingly small when one moves away from the handle (see FIGS. 10 and 11).

Figure 18:
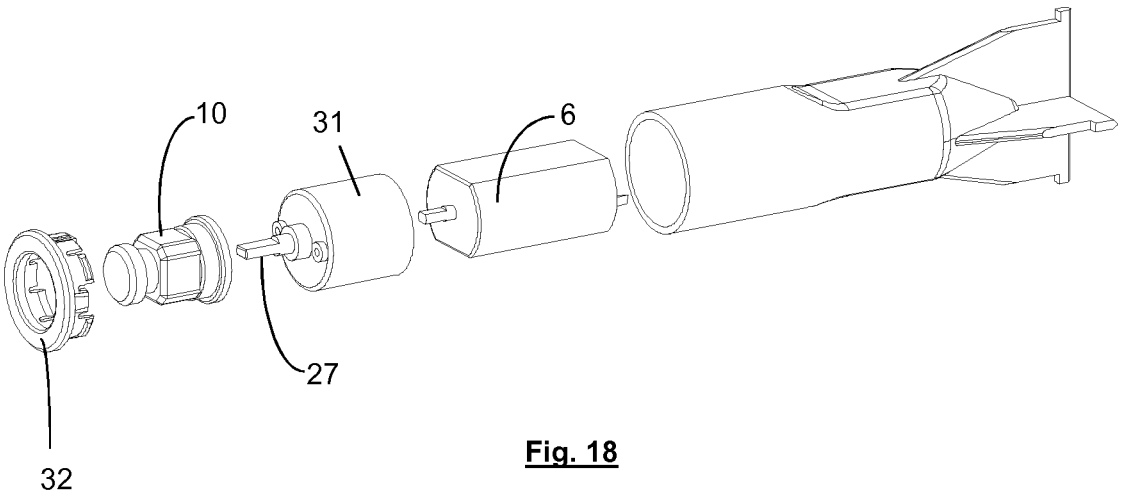
FIG. 18 shows an exploded view of the support rod of the second motor.

The motor support rod coming out of the handle, including, in its hollow part, the motor driving the brush and a gearbox, comprises a male polygonal coupling element at the end that cooperates with a corresponding female recess on the brush, allowing quick assembly and disassembly of the accessory. The support rod, once assembled, is closed by a cover that closes the assembly (see FIG. 18).

In one preferred embodiment of the invention, the coupling element is square and is attached directly on the axis of the gearbox of the second motor without any intermediate part. The motors used are preferably brushless motors, but it is also possible to consider using an ordinary motor. In both cases, a torque limiter or a mechanical release may be considered if a given force couple is exceeded, so as not to force the motor during inappropriate use.

The suction of air that passes through an outer grid, a filter and an inner grid takes place at one of the ends of the handle, on the compressor side. The filter, generally made from plastic foam, is maintained by a support, here in the form of a lattice pattern (see FIG. 13). To allow the cleaning of these elements, the outer suction grid is mounted on a hinge.

The cylindrical brush with its air outlet openings is generally made from metal, preferably aluminum, and preferably comprises a ceramic layer for a more uniform distribution of heat. The cylindrical brush also comprises a locking mechanism protruding slightly relative to the surface containing the cylinder (see FIGS. 10 and 11).

The device also comprises an ionizer located in the handle, in the extension of the first motor, so as not to affect the flow of air. It is also provided with a double protective grid at the air intake.

Figure 14:
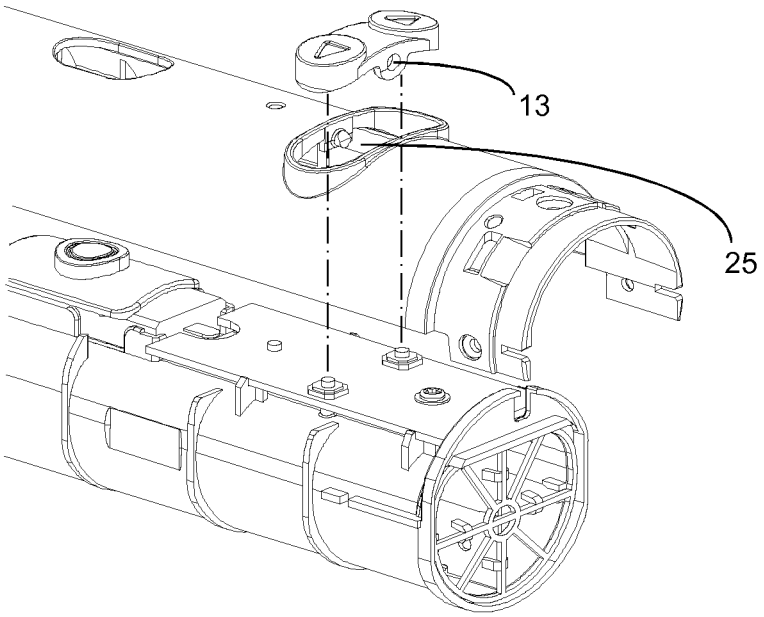
FIG. 14 shows the assembly mechanism of the upper half-shell allowing the switch to be balanced, giving the rotation direction of the accessory.

Like all rotary blower brushes, it also comprises a main switch adjusting the flow and the temperature of the air leaving the handle and a secondary switch making it possible to choose the clockwise or counterclockwise direction of rotation of the cylindrical brush. The switch is mounted on a spring lever system allowing it to automatically return to its equilibrium position after being actuated (see FIG. 14).

Figure 15:
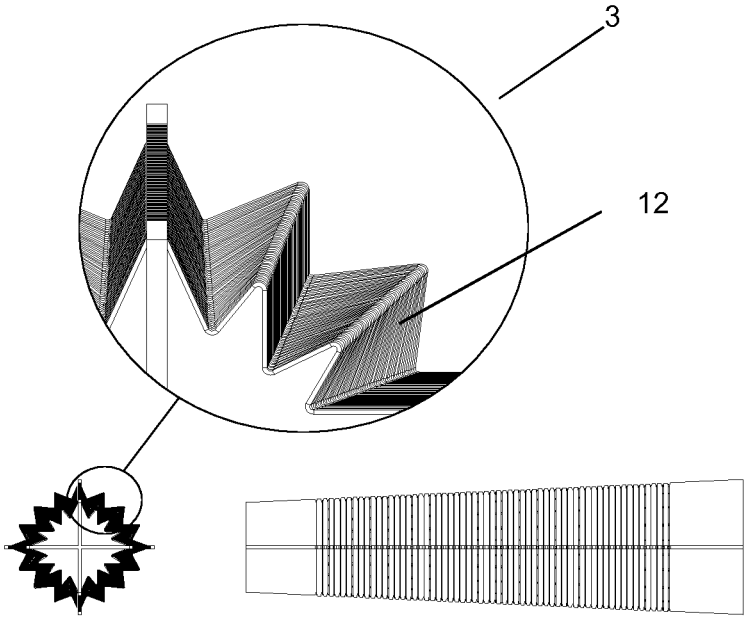
FIG. 15 shows a first winding variant of the wire for the heating resistance.
Figure 16:
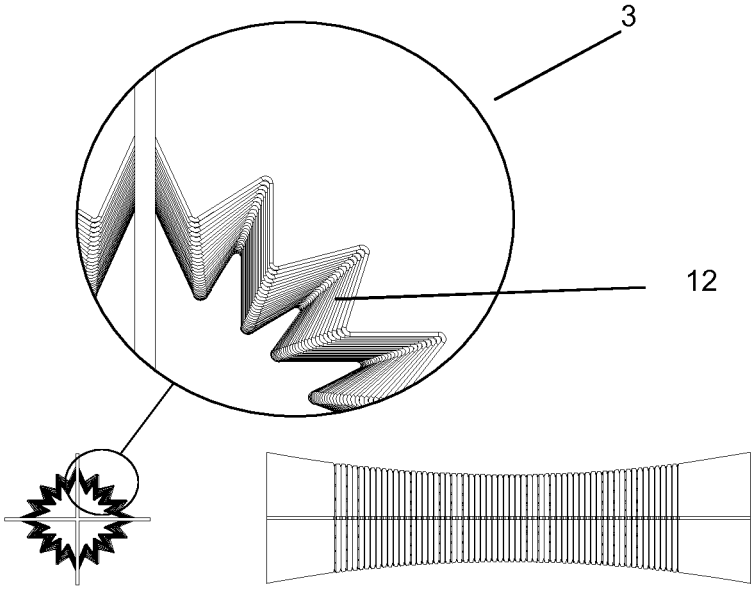
FIG. 16 shows a second winding variant of the wire for the heating resistance.
Figure 17:
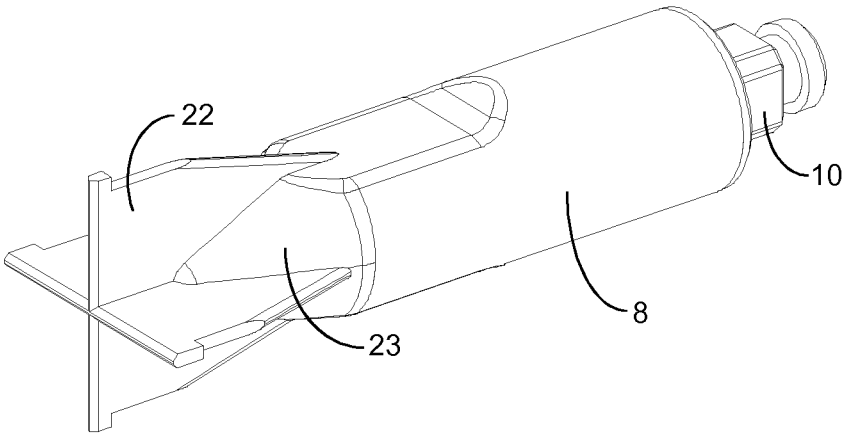
FIG. 17 shows a 3D view of the support rod of the second motor.

The winding of the wires of the heating resistance may have a star coil configuration (see FIGS. 15 and 16).

It has been noted that the temperature adjustment was facilitated by positioning a temperature probe at the end of the support rod rather than in the handle due to the proximity of the heating elements giving off heat. To respect the regulations relative to electrical safety, the cylindrical brush may be fixedly (not removably) mounted or its removal may be connected to a mechanism cutting off the electrical contact upon removal of the cylindrical brush.

The invention claimed is:

1. A rotary blower brush of length L comprising:

a handle, a heater, a first motor configured to drive a compressor, and a second motor configured to drive a cylindrical brush in rotation, the first motor, the heater, and the compressor being positioned in the handle, and the second motor being located outside the handle in a support rod; and a plurality of straightening fins disposed downstream of a fan of the compressor, wherein the plurality of straightening fins are disposed on a housing of the first motor and an airflow exiting the compressor is guided by the plurality of straightening fins;

wherein the handle comprises two separate zones of different diameters, a first zone having a first diameter D1 and a second zone having a second diameter D2, the first diameter D1 being greater than the second diameter D2, the first zone of diameter D1 accommodating the compressor and the second zone of diameter D2 corresponding to a gripping zone of the rotary blower brush.

2. The rotary blower brush according to claim 1, wherein the diameter D2 is 10% smaller than the diameter D1.

3. The rotary blower brush according to claim 1, wherein the diameter D2 of the gripping zone represents less than 15% of the total of length L.

4. The rotary blower brush according to claim 1, wherein the compressor maintains a substantially constant flow rate between 300 and 1000 l/min.

5. The rotary blower brush according to claim 1, wherein a ratio between a power of the heater in watts and an air flow rate of the compressor in l/min is between 1 and 2.5.

6. The rotary blower brush according to claim 1, wherein the two motors are brushless motors.

7. The rotary blower brush according to claim 1, wherein the handle comprises a temperature sensor disposed at an outlet of the handle and controlled by a heating power of the heater, allowing the rotary blower brush to avoid overheating.

8. The rotary blower brush according to claim 1, wherein the cylindrical brush comprises air outlet openings arranged at least partially in concentric rings, a diameter of the rings decreasing progressively as one moves away from the handle.

9. The rotary blower brush according to claim 1, wherein the handle comprises an ion generator located in an extension of the motor of the compressor.

10. The rotary blower brush according to claim 1, wherein the support rod of the motor comprises a polygonal coupling element cooperating with the cylindrical brush of the rotary blower brush.

11. The rotary blower brush according to claim 1, wherein the cylindrical brush of the rotary blower brush comprises a metal covered with a ceramic layer.

12. The rotary blower brush according to claim 1, wherein a temperature sensor is disposed on the support rod so as to allow an air flow of the compressor and a heating power of the rotary blower brush to be adjusted based on a sensed temperature.

13. The rotary blower brush according to claim 1, wherein the rotary blower brush comprises a system for detecting a type of the cylindrical brush, allowing an air flow of the compressor, a heating power of the rotary blower brush, and a rotation speed of the motor to be adjusted based on the type.

14. The rotary blower brush of claim 1, wherein upstream ends of the plurality of straightening fins are curved.

15. The rotary blower brush of claim 14, wherein the plurality of straightening fins are configured to direct the airflow through a length of the second zone.

16. The rotary blower brush of claim 1, further comprising a plurality of radial attachment fins disposed on an upstream end of the support rod.

17. The rotary blower brush of claim 16, wherein a downstream end of the handle comprises a pair of half-shells disposed around the attachment fins of the support rod.

18. The rotary blower brush of claim 17, further comprising an outer assembly ring securing the pair of half-shells to the attachment fins of the support rod.

19. A rotary blower brush of length L comprising:

a handle, a heater, a first motor configured to drive a compressor, and a second motor configured to drive a cylindrical brush in rotation, the first motor, the heater, and the compressor being positioned in the handle, and the second motor being located outside the handle in a support rod; and a plurality of radial attachment fins disposed on an upstream end of the support rod;

wherein the handle comprises two separate zones of different diameters, a first zone having a first diameter D1 and a second zone having a second diameter D2, the first diameter D1 being greater than the second diameter D2, the first zone of diameter D1 accommodating the compressor and the second zone of diameter D2 corresponding to a gripping zone of the rotary blower brush.

20. The rotary blower brush according to claim 19, wherein the diameter D2 is 10% smaller than the diameter D1.

21. The rotary blower brush according to claim 19, wherein the diameter D2 of the gripping zone represents less than 15% of the total of length L.

22. The rotary blower brush according to claim 19, wherein the compressor maintains a substantially constant flow rate between 300 and 1000 l/min.

23. The rotary blower brush according to claim 19, wherein a ratio between a power of the heater in watts and an air flow rate of the compressor in l/min is between 1 and 2.5.

24. The rotary blower brush according to claim 19, further comprising a plurality of straightening fins disposed downstream of a fan of the compressor, wherein an airflow exiting the compressor is guided by the plurality of straightening fins.

25. The rotary blower brush of claim 24, wherein the plurality of straightening fins are disposed on a housing of the first motor.

26. The rotary blower brush of claim 25, wherein upstream ends of the plurality of straightening fins are curved.

27. The rotary blower brush of claim 26, wherein the plurality of straightening fins are configured to direct the airflow through a length of the second zone.

28. The rotary blower brush according to claim 19, wherein the two motors are brushless motors.

29. The rotary blower brush according to claim 19, wherein the handle comprises a temperature sensor disposed at an outlet of the handle and controlled by a heating power of the heater, allowing the rotary blower brush to avoid overheating.

30. The rotary blower brush according to claim 19, wherein the cylindrical brush comprises air outlet openings arranged at least partially in concentric rings, a diameter of the rings decreasing progressively as one moves away from the handle.

31. The rotary blower brush according to claim 19, wherein the handle comprises an ion generator located in an extension of the motor of the compressor.

32. The rotary blower brush according to claim 19, wherein the support rod of the motor comprises a polygonal coupling element cooperating with the cylindrical brush of the rotary blower brush.

33. The rotary blower brush according to claim 19, wherein the cylindrical brush of the rotary blower brush comprises a metal covered with a ceramic layer.

34. The rotary blower brush according to claim 19, wherein a temperature sensor is disposed on the support rod so as to allow an air flow of the compressor and a heating power of the rotary blower brush to be adjusted based on a sensed temperature.

35. The rotary blower brush according to claim 19, wherein the rotary blower brush comprises a system for detecting a type of the cylindrical brush, allowing an air flow of the compressor, a heating power of the rotary blower brush, and a rotation speed of the motor to be adjusted based on the type.

36. The rotary blower brush of claim 19, wherein a downstream end of the handle comprises a pair of half-shells disposed around the attachment fins of the support rod.

37. The rotary blower brush of claim 36, further comprising an outer assembly ring securing the pair of half-shells to the attachment fins of the support rod.

* * * * *